US005279034A

United States Patent [19]

Smith et al.

[11] Patent Number: 5,279,034

[45] Date of Patent: Jan. 18, 1994

[54] SCISSORS

[75] Inventors: Steve Smith, Metairie, La.; Bob P. Lemaire, Cordova, Tenn.

[73] Assignee: The Caper Company, Metairie, La.

[21] Appl. No.: 983,944

[22] Filed: Dec. 1, 1992

[51] Int. Cl.[5] ..... B26B 13/00

[52] U.S. Cl. ..... 30/232; 30/341

[58] Field of Search ..... 30/231, 232, 298, 336, 30/340, 341, 343, 252

[56] References Cited

U.S. PATENT DOCUMENTS

| | | | |
|---|---|---|---|
| 25,508 | 9/1859 | Heinisch | 30/341 |
| 160,102 | 2/1875 | Johnson | 30/341 |
| 299,310 | 5/1884 | Witte | 30/341 |
| 354,363 | 12/1886 | Titus | 30/232 |
| 760,204 | 5/1904 | Heinisch | 30/341 |
| 1,775,562 | 9/1930 | Kerns | 30/232 |
| 4,453,311 | 6/1984 | Twigger | 30/341 |
| 4,635,363 | 1/1987 | Chapin | 30/341 |
| 5,146,810 | 9/1992 | Mueller | 30/232 |

*Primary Examiner*—Douglas D. Watts
*Assistant Examiner*—Paul M. Heyrana, Sr.
*Attorney, Agent, or Firm*—David H. Semmes

[57] ABSTRACT

Scissors or shears of the pivoted cross-blade type, adapted for relief of carpal tunnel syndrome and other hand repetitive stress injuries. The scissors upper and lower handles are characterized by especial contours which immobilize the thumb and index finger, while presenting the stronger middle finger, ring finger and little finger for flexing or gripping action to operate the scissors.

8 Claims, 4 Drawing Sheets

SCISSORS

BACKGROUND OF THE INVENTION

1. Field of the Invention

Scissors or shears, particularly scissors of the pivoted cross-blade type having handles adapted for relief of carpal tunnel syndrome and muscular stress due to repetitive and fatiguing opening and closing of the scissors. The term "scissors" is applied generically to pivoted cross-blade instruments including cutting shears, tin snips, gardening shears, industrial tools, and medical, surgical and dental tools.

2. Discussion of the Prior Art

| | |
|---|---|
| CURUTCHET | 3,407,816 |
| CHARLES et al. | 3,861,038 |
| YGFORS | 3,921,478 |
| CEDERGREEN et al. | 4,965,958 |

Earlier patentees have attempted to eliminate scissors operator fatigue in the poultry, tailoring, quilting and like industries where scissors are the principal operator tool. One approach has been to apply to interpose a compression spring between the free ends of the scissors handles so as to urge the scissors closed. CHARLES U.S. Pat. No. 3,861,038 has attempted to contour the scissors handles to fit the human hand.

Applicants' improvement consists in contouring the scissors handles to immobilize the thumb and index fingers and to preserve the middle, ring and little finger for gripping, thus enabling the scissors to be activated by the squeezing action of the middle, ring and little fingers—as opposed to the conventional pinching action of the thumb towards the index finger.

SUMMARY OF THE INVENTION

Applicants utilize shears of the pivoted cross-blade type having handle extensions for engagement with the human hand. Applicants' improvement consists in combined and ergonomic contouring of the upper handle and the lower handle. As a result, the thumb is immobilized within the upper handle and the index finger is essentially immobilized within the lower handle. In the lower handle a special surface is provided for engagement of the middle finger, ring finger and little finger. As a result, the scissors are activated by flexing or squeezing of the middle, ring and little finger, which causes the lower handle to move in abutment with the upper handle, thereby closing the cross blades. In the upper handle, a bollard is provided which extends vertically between the thumb and index finger so as to traverse the web between thumb and index finger and extend over the joint between the thumb first metacarpal and thumb first phalanx and to the joint between the index finger first metacarpal and the index finger first phalanx. The bollard thus overlaps a portion of the thumb first phalanx and a portion of the index finger joint between the metacarpal and first phalanx, both as a guard of these areas and an assistance in scissors handling without squeezing. This also prevents the hand from slipping forward.

The lower portion of the upper handle is conformed to extend across the palm of the human hand from the joint between the index finger metacarpal and index finger first phalanx to the short palmaris of the hand. As a consequence, the entire thumb, extending from the short flexor or ball to the second phalanx and ungual tuberosity is immobilized. As a result, the scissors are activated by movement of the lower handle, flexing, i.e., squeezing of the middle finger, ring finger and little finger, rather than movement of the upper handle through conventional squeezing of the thumb towards the index finger. This "grip" action develops 4 times more torque than the pinch action of traditional scissors.

As a result, carpal tunnel syndrome and muscular fatigue in scissors operators is essentially eliminated.

DESCRIPTION OF THE PREFERRED EMBODIMENTS

Figure 1:
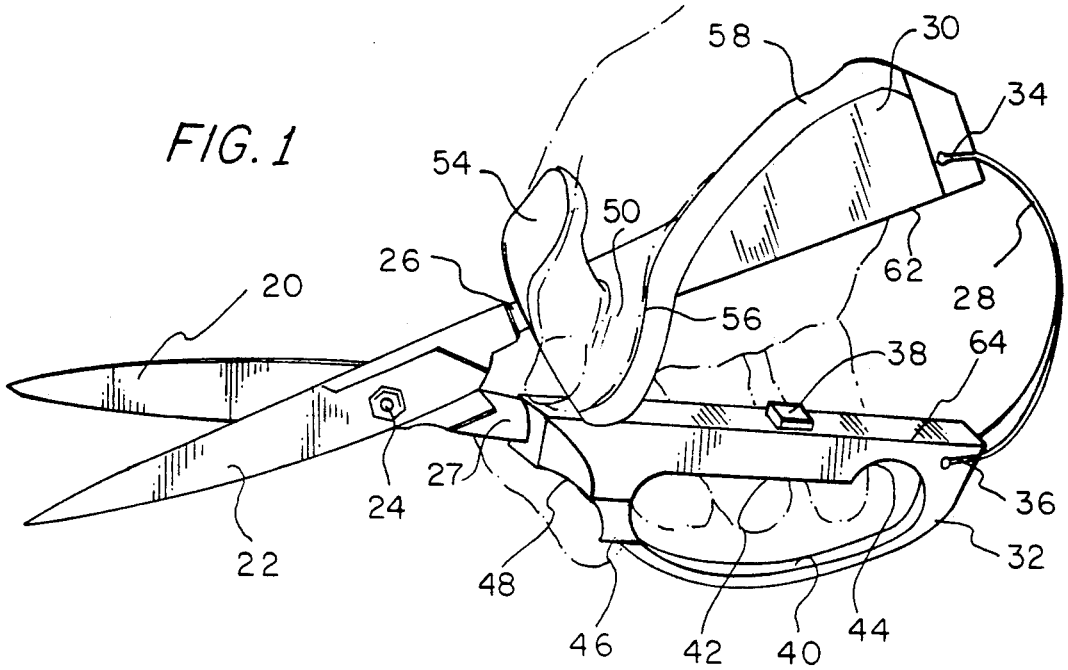
FIG. 1 is a perspective view of the human hand engaging the scissors upper handle and lower handle.

In FIG. 1 a pair of scissors of the pivoted cross-blade type is illustrated as employing scissor blades 20, 22 pivoted upon stove bolt 24 or the like and embodying upper handle 30 and lower handle 32. Upper handle 30 is fitted to the blade 22 handle extension 26 and lower handle 32 is secured to handle extension 27 by conventional means. An elongated spring 28 may extend between the handles 30 and 32 and be removably secured in respective key hole slots 34, 36.

Upper handle 30 includes a vertically extending bollard 66 conformed so as to extend over and transversely between the thumb first phalanx and the joint of the index finger between the metacarpal bone and the first phalanx. As a result, the bollard protects the web between thumb and index finger and, also, enables the entire scissors assembly to be lifted, carried or directed without squeezing of thumb or fingers. It also prevents the hand from slipping forward.

Lower handle 32 includes finger guard 40, surface 42 for engagement of middle finger and ring finger and offset surface 44 for engagement of the shorter little finger. A laterally extending boss 46 defines an index finger concavity or rest 48.

Figure 6:
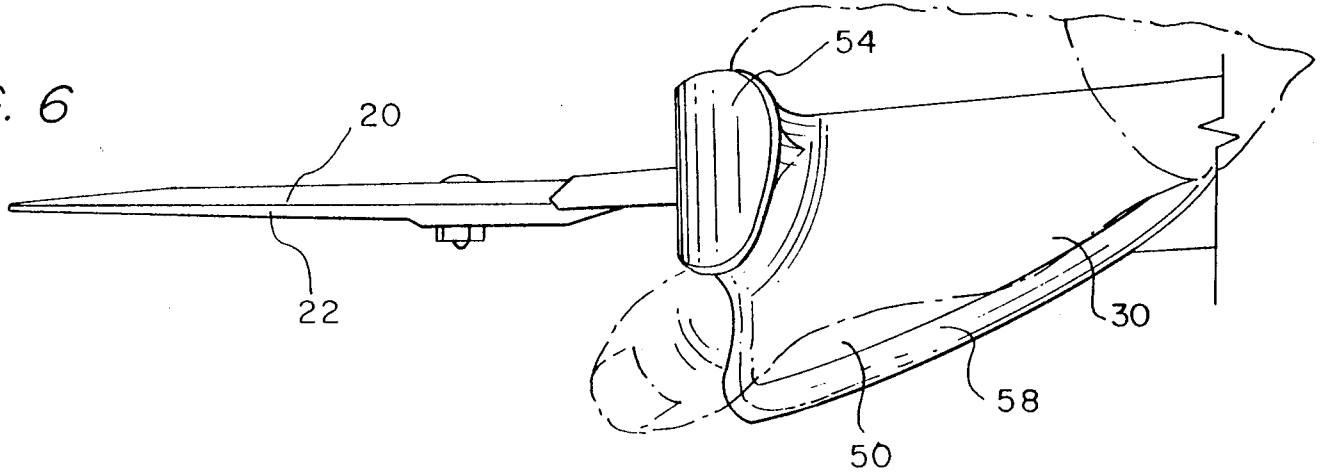
FIG. 6 is a top plan showing the human hand engaging the top handle.
Figure 5:
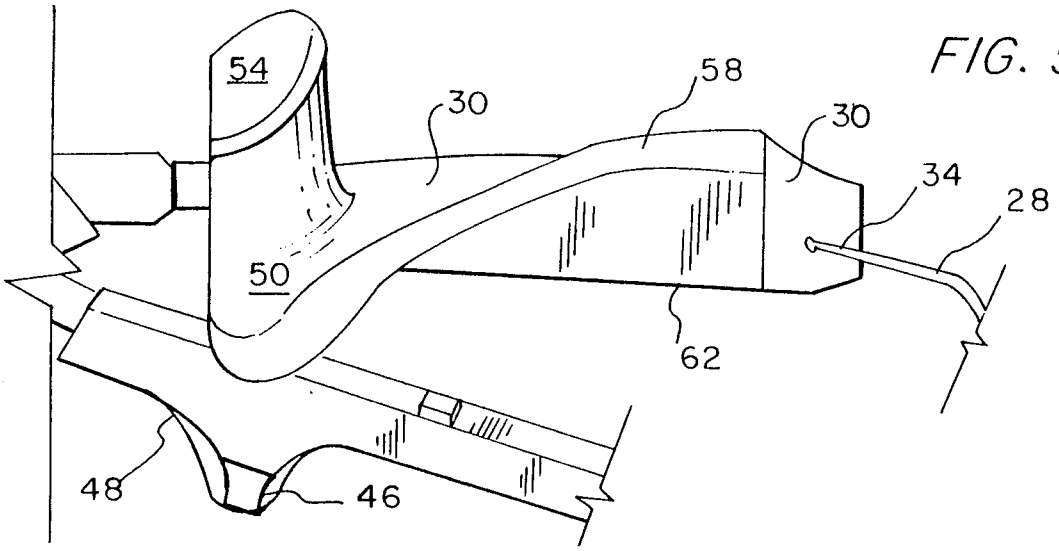
FIG. 5 is a top plan of the scissors handles.

As illustrated in FIGS. 1, 5 and 6, upper handle 30 includes an outer edge 58 which defines concavity 50 for immobilizing the entire thumb extending from a mid-portion of the second phalanx through the joint between the first phalanx and metacarpal to the short palmaris or ball of the thumb. As the human hand grasps the upper and lower handles 30, 32 as illustrated in FIG. 1, the tip of the index finger is immobilized in concavity 48 and the entire thumb is immobilized in concavity 50, while the middle finger and ring finger and engage lower handle 32 and the little finger may engage offset cavity 44. As the middle finger, ring finger and little finger are thusly flexed, the lower handle 32 upper surface 64 is urged towards the upper handle lower surface 62. This flexing and urging of lower handle 32 towards upper handle 30 is dramatically different from conventional scissoring action wherein the upper handle is pivoted or squeezed towards the lower handle by pinching action of the thumb toward the index finger.

A fine tuning boss or edge 38 may be provided to adjust the degree of closure between the surfaces 62, 64.

Figure 2:
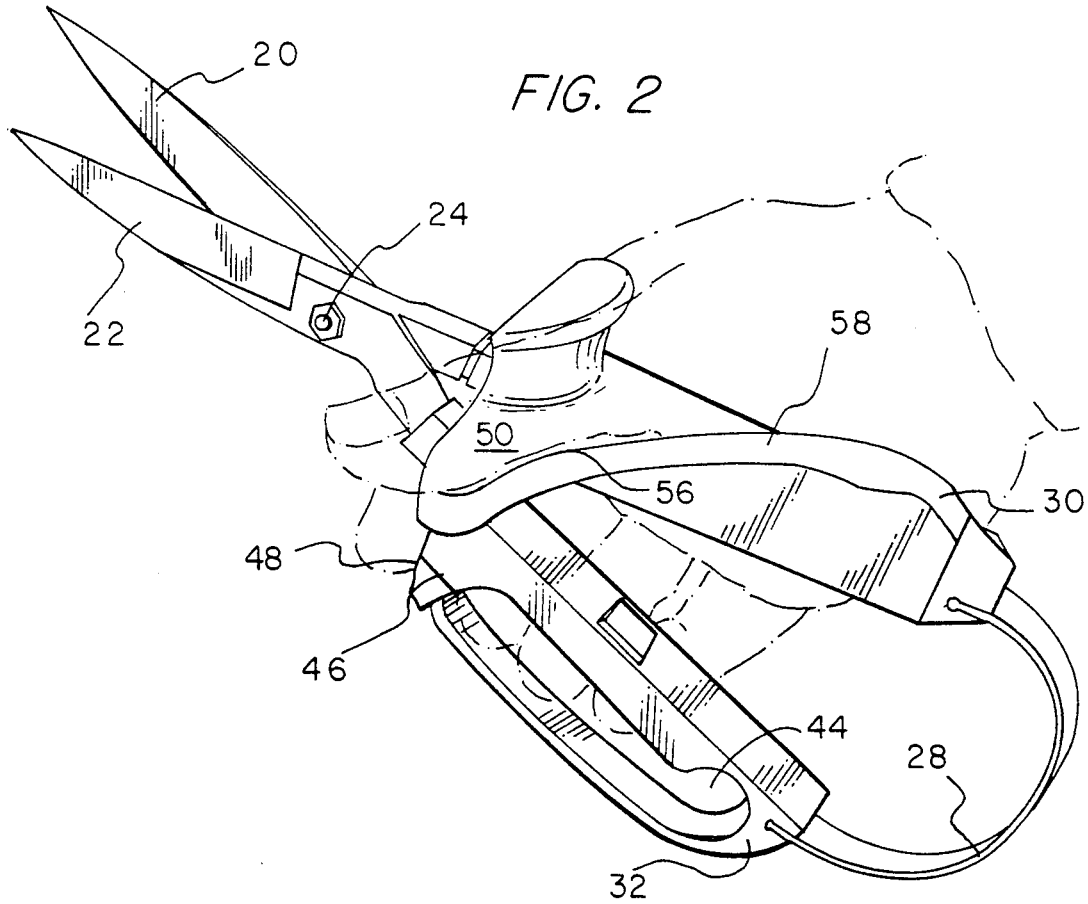
FIG. 2 is a similar perspective from another angle.
Figure 3:
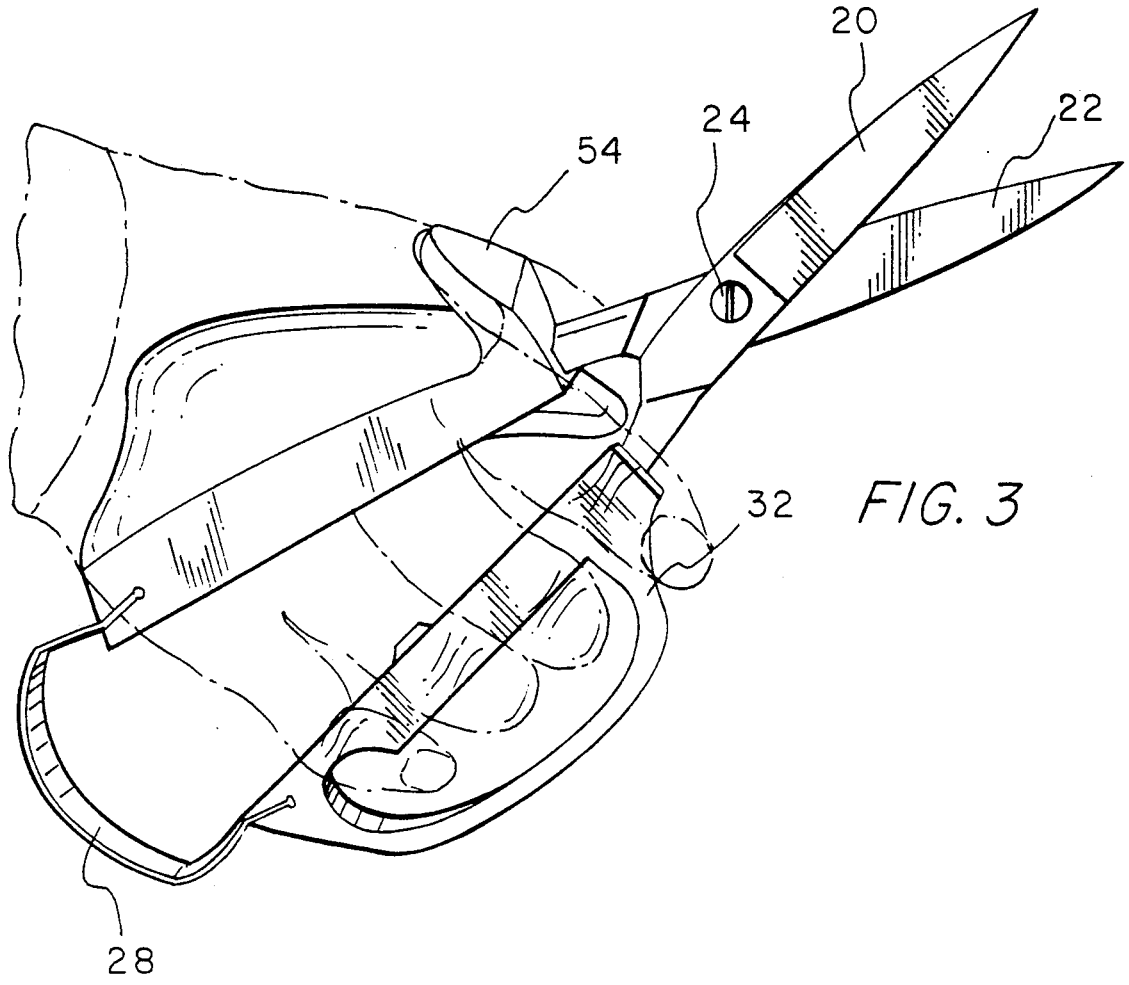
FIG. 3 is a perspective view from the rear of the human hand engaging the scissor handles.
Figure 4:
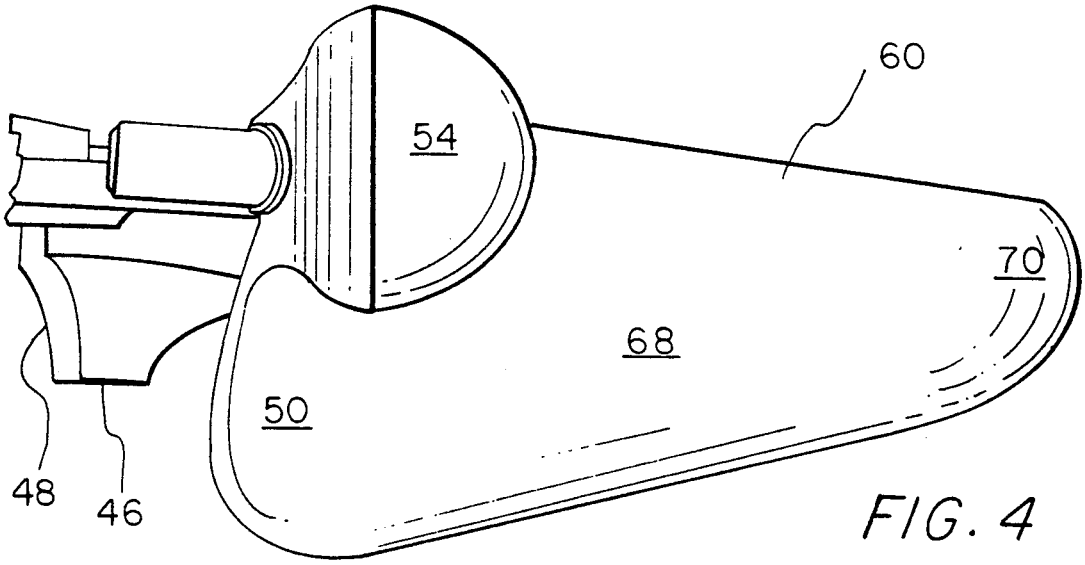
FIG. 4 is an enlarged perspective of the scissors upper handle and partial bottom handle.
Figure 7:
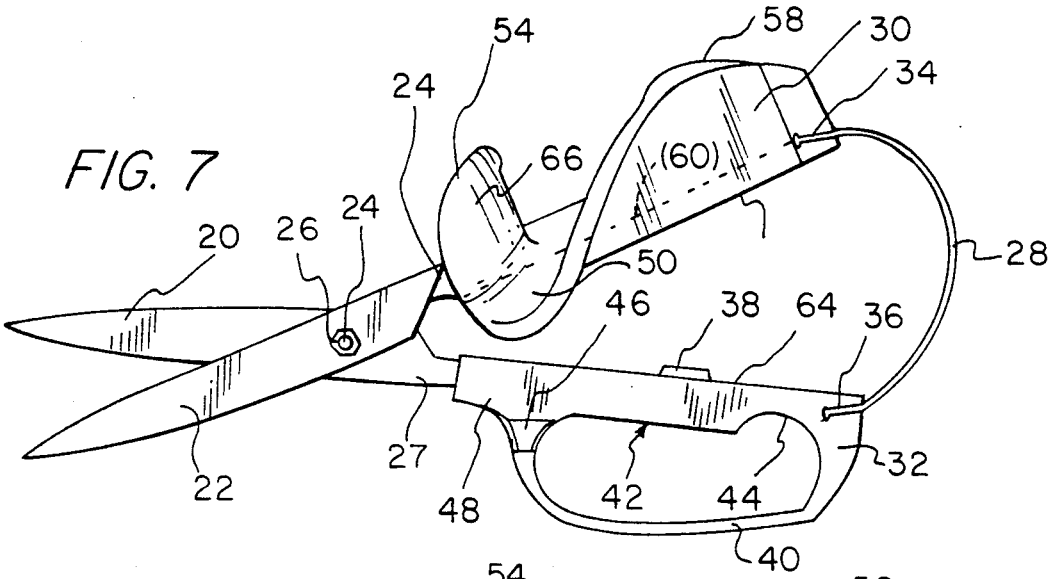
FIG. 7 is a front elevation of the scissors in open position.

In FIG. 7 the scissors are illustrated in open position wherein blades 20, 22 are pivoted upon set screw 24 and secured thereto by means of nut 26. Bollard 66 is conformed on its front or leading edge to engage the joint between the thumb first and second phalanx and the inside of the thumb, such that the thumb tip or ungual tuberosity extends over the edge of surface 50, as illustrated in FIGS. 1 and 2. Thumb concavity 50 is defined, also, by outer edge 58 and horizontal inner edge 60, which engages the inside of the human hand in extending from the index finger joint between index metacarpal and first phalanx as its forward end and the short palmaris of the palm at its other end. Thus, the handle 30 and surface 60 extends transversely across the palm of the human hand. In FIG. 4 the concavity 50 is shown as including a mid-portion 68 which engages the base or ball of the thumb and a posterior portion 70 which engages the palmaris.

Figure 8:
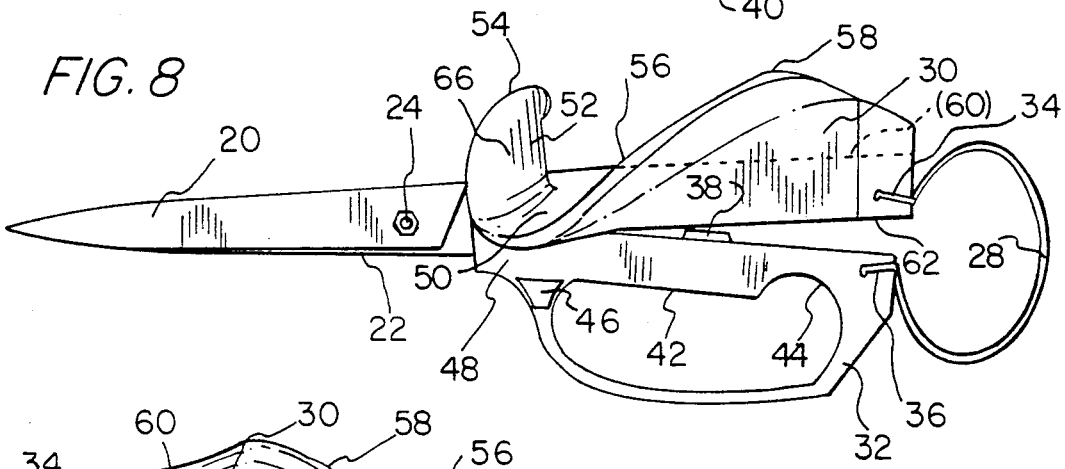
FIG. 8 is a front elevation of the scissors closed.

In FIG. 8 the scissors are shown in closed position with the fine tuning boss 38 engaging handle 30 lower surface 62. As shown in FIG. 1, an anterior portion 56 of edge 58, is conformed to engage the thumb first phalanx while the tip of the thumb extends over the leading edge of concavity 50.

Figure 9:
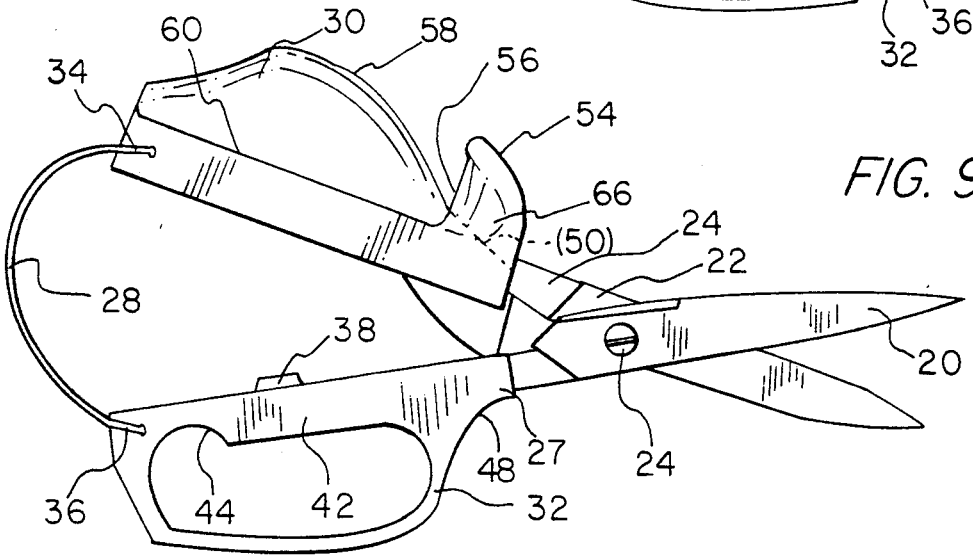
FIG. 9 is a rear elevation of the scissors in open position.

In FIG. 9 the scissors are illustrated in rear elevation with the leading edge of concavity 50 shown in phantom.

Prior art scissors devices are activated by moving the upper handle by use of the thumb, i.e., moving of the thumb towards the index finger. Applicants in contrast, immobilizes the thumb and activates their device by moving the lower handle through flexing of the strongest part of the hand, namely the middle, ring and little fingers. Carpal tunnel syndrome is essentially eliminated by applicants' ergonomic approach to the contouring scissor handles. Manifestly, applicants can rotate the upper and lower handles upon their longitudinal axes and can especially contour each handle to conform to the particular biomechanics of the human hand. Applicants' device essentially activates the scissors by gripping action of the middle, ring and index finger, as opposed to pinching action of the thumb in conventional scissors. It is medically recognized that the middle, ring and little fingers provide the greater part of strength in the human hand. Applicants by immobilizing the thumb have transferred the work load from the thumb to the strongest part of the hand. Although the thumb and index finger are essentially immobilized, they are still used as fine tuners or guides and are protected by the bollard 66 and bridge 54. As shown in FIGS. 1, 2 and 4, the angle of the index or trigger finger concavity 48, as well as the angle of the little finger concavity 44 are adapted to the posture of the human hand in flexed or gripping position. As is also apparent, the use of the scissors is not restricted to the poultry, tailoring, quilting or gardening industries. Manifestly, variations in handle contour may be employed and the handles may be applied to a wide range of pivoted cross-blade instruments without departing from the spirit of the claims.

We claim:

1. In shears of the pivoted cross-blade type, each cross-blade having a handle extension for engagement with the human hand, the combination of:

a) an upper handle secured to a first cross-blade handle extension and contoured to fit both the inner face of the human thumb and a diagonal section of the human palm, said upper handle further including a vertically extending bollard having a forward end extending between the thumb and index finger;

b) a lower handle secured to a second cross-blade handle extension and having a forward end contoured to engage the human index finger and a trailing end contoured to fit the human middle, ring and little fingers; and c) a spring resiliently extending between said first and second cross-blade handle extensions, so as to urge apart said cross-blades;

(d) each cross-blade having a handle extension for engagement with the human hand, said upper handle bollard including a guard portion extending transversely between the thumb outer phalange and the index finger inner phalange.

2. In shears of the pivoted cross-blade type, each cross-blade having a handle extension for engagement with the human hand is in claim 1, said upper handle bollard including a forward inner portion contoured to fit the joint between the first second phalanges of the human thumb.

3. In shears of the pivoted cross-blade type, each cross-blade having a handle extension for engagement with the human hand as in claim 2, said spring being in the form of an elongated strip.

4. In shears of the pivoted cross-blade type, each cross-blade having a handle extension with the human hand as in claim 3, said bollard having a trailing end portion extending over the web of the human hand between the thumb and index finger.

5. In shears of the pivoted cross-blade type, each cross-blade having a handle extension for engagement with the human hand as in claim 3, said lower handle having a forward portion contoured to fit the human index finger tip, and a mid-portion contoured to fit the middle, ring and little finger tips in gripping posture.

6. In shears of the pivoted cross-blade type, each cross-blade having a handle extension for engagement with the human hand as in claim 5, said lower handle including a guard portion extending outwardly of said forward portion and said mid-portion.

7. In shears of the pivoted cross-blade type, each cross-blade having a handle extension for engagement with the human hand as in claim 6, said lower handle forward contoured portion being aligned towards the tip of the human thumb seated in said upper handle in immobilized posture.

8. In shears of the pivoted cross-blade type, each cross-blade having a handle extension for engagement with the human hand as in claim 2, said upper handle bollard including a forward outer portion contoured to fit the joint between the index finger metacarpal and first phalanx.

* * * * *